US011154108B2

(12) United States Patent
LaRocque

(10) Patent No.: US 11,154,108 B2
(45) Date of Patent: Oct. 26, 2021

(54) VENTED SOFT-SIDED HELMET

(71) Applicant: Joey LaRocque, Agoura Hills, CA (US)

(72) Inventor: Joey LaRocque, Agoura Hills, CA (US)

( * ) Notice: Subject to any disclaimer, the term of this patent is extended or adjusted under 35 U.S.C. 154(b) by 494 days.

(21) Appl. No.: 14/631,357

(22) Filed: Feb. 25, 2015

(65) Prior Publication Data

US 2016/0242487 A1 Aug. 25, 2016

(51) Int. Cl.

| | |
|---|---|
| ***A42B 3/28*** | (2006.01) |
| ***A42B 3/16*** | (2006.01) |
| ***A42B 3/06*** | (2006.01) |

(52) U.S. Cl.

CPC ..... *A42B 3/283* (2013.01); *A42B 3/069* (2013.01); *A42B 3/16* (2013.01)

(58) Field of Classification Search

CPC ..... A42B 3/283; A42B 3/069; A42B 3/281; A42B 3/28

See application file for complete search history.

(56) References Cited

U.S. PATENT DOCUMENTS

| | | | | |
|---|---|---|---|---|
| 1,434,607 | A | 11/1922 | Gilson | |
| 1,841,232 | A | 1/1932 | Wells | |
| D100,814 | S | 8/1936 | Fisken | |
| 2,140,716 | A | 12/1938 | Pryale | |
| 2,372,715 | A | 4/1945 | Ernst | |
| 2,546,117 | A | 3/1951 | Whelan | |
| 2,594,478 | A | 4/1952 | Moore | |
| 2,664,567 | A | 1/1954 | Nichols | |
| 2,777,127 | A | 1/1957 | Marietta | |
| D181,686 | S | 12/1957 | Stuart | |
| 3,105,240 | A | 10/1963 | Jansson | |
| 3,186,004 | A * | 6/1965 | Carlini | A42B 3/122 2/413 |
| 3,197,784 | A | 8/1965 | Carlisle | |
| 3,323,134 | A | 6/1967 | Swyers | |
| D213,085 | S | 1/1969 | Wyckoff | |
| 3,435,460 | A | 4/1969 | Grant | |
| 3,551,911 | A * | 1/1971 | Holden | A42B 3/00 2/411 |

(Continued)

FOREIGN PATENT DOCUMENTS

| | | |
|---|---|---|
| EP | 0930832 | 8/1997 |
| WO | 9708967 | 3/1997 |

OTHER PUBLICATIONS http://www.amazon.com/Best-Sellers-Sports-Outdoors-Rugby-Headguards/zgbs/sporting-goods/3416031. (Amazon Best Sellers_ best Rugby Headguards) (last accessed Jul. 22, 2015).

*Primary Examiner* — Alissa J Tompkins
*Assistant Examiner* — Brieanna Szafran
(74) *Attorney, Agent, or Firm* — McAndrews, Held & Malloy, Ltd.

(57) ABSTRACT

A soft-sided helmet may comprise a ventilation system having at least two radial vents, including a first radial vent and a second radial vent; at least a first air channel connecting the first radial vent to at least one other radial vent; and at least a second air channel connecting the second radial vent to at least one other radial vent. The first radial vent may oppose the second radial vent. The ventilation system may further comprise further radial vents, which optionally may be connected to each other via one or more air channels.

17 Claims, 10 Drawing Sheets

(56) References Cited

U.S. PATENT DOCUMENTS 3,566,409 A * 3/1971 Hopper ..... A42B 1/08 2/414
D220,376 S 4/1971 Brown
3,720,955 A 3/1973 Rawlings
3,761,959 A 10/1973 Dunning
3,778,844 A * 12/1973 Hori ..... A42B 3/163 2/423
3,789,467 A * 2/1974 Aratani ..... A42B 3/08 24/313
D230,911 S 3/1974 Ispas
3,818,508 A 6/1974 Lammers
3,820,163 A 6/1974 Rappleyea
3,860,966 A * 1/1975 Brown ..... A42B 3/32 2/415
3,934,271 A 1/1976 Rhee
3,935,044 A 1/1976 Daly
3,978,527 A 9/1976 Bednar
D243,484 S 3/1977 Rhee
4,095,294 A 6/1978 Winterbottom
4,134,156 A 1/1979 Gyory
D253,976 S 1/1980 Davidson
D255,394 S 6/1980 McNabb
4,222,122 A 9/1980 Toms
4,279,038 A 7/1981 Bruckner
D295,800 S 5/1988 Shelton
4,754,501 A 7/1988 Yahn
D298,179 S 10/1988 Strong
D299,180 S 1/1989 Gentes
4,808,469 A 2/1989 Hiles
4,843,642 A 7/1989 Brower
4,845,786 A 7/1989 Chiarella
5,012,533 A 5/1991 Raffler
D318,747 S 7/1991 Barker
5,035,009 A 7/1991 Wingo
D330,271 S 10/1992 Samples
5,177,815 A 1/1993 Andujar
5,271,103 A 12/1993 Darnell
5,324,460 A 6/1994 Briggs
D352,333 S 11/1994 Lieberman
5,361,410 A 11/1994 Sigl
5,361,420 A 11/1994 Dobbs
D355,508 S 2/1995 Tutton
D363,571 S 10/1995 Klose
D366,347 S 1/1996 Avey
D366,557 S 1/1996 Ashby
5,515,546 A 5/1996 Shifrin
5,537,687 A 7/1996 Garza
D378,236 S 2/1997 Zanotto et al.
D378,624 S 3/1997 Chartrand
D382,370 S 8/1997 Comstock
D382,671 S 8/1997 Shewchenko
D387,502 S 12/1997 Comstock
5,713,082 A 2/1998 Bassette
5,745,923 A * 5/1998 Katz ..... A42B 3/00 2/411
D401,018 S 11/1998 Chartrand
D412,376 S 7/1999 Jurga
D412,766 S 8/1999 Tang
5,930,841 A 8/1999 Lampe
D415,593 S 10/1999 Tang
6,065,159 A * 5/2000 Hirsh ..... A42B 1/08 2/413
6,073,271 A 6/2000 Alexander
6,088,840 A 7/2000 Im
D429,035 S 8/2000 Purnell
6,108,825 A * 8/2000 Bell ..... A42B 3/063 2/455
6,159,324 A 12/2000 Watters
D443,405 S 6/2001 Quiroz
D444,269 S 6/2001 Jeffreys
D445,962 S 7/2001 Brignone
6,266,827 B1 7/2001 Lampe
D448,890 S 10/2001 Brignone
D449,411 S 10/2001 Largeot
D453,056 S 1/2002 Garneau
D453,399 S 2/2002 Racine
6,389,607 B1 5/2002 Wood
6,389,608 B1 * 5/2002 Williams ..... A42B 3/00 2/411
D459,032 S 6/2002 Gatellet
D459,554 S 6/2002 Gatellet
D459,555 S 6/2002 Gatellet
D460,584 S 7/2002 Green
6,421,840 B1 7/2002 Chen
D461,152 S 8/2002 Schmitt
D465,067 S 10/2002 Ide et al.
D466,651 S 12/2002 Halstead et al.
D479,020 S 8/2003 Heinrich
6,625,820 B1 9/2003 Lampe
D482,163 S 11/2003 Brown
D490,572 S 5/2004 Finquel
D495,093 S 8/2004 Tintera
D498,334 S 11/2004 Durocher
D500,894 S 1/2005 Coutant
6,934,971 B2 8/2005 Ide
D511,026 S 10/2005 Ide
D512,534 S 12/2005 Maddux et al.
D528,705 S 9/2006 Ide
D529,233 S 9/2006 Schneider
D541,480 S 4/2007 Turner
D545,501 S 6/2007 Green
D556,951 S 12/2007 Gath
D567,455 S 4/2008 Rogers
D581,599 S 11/2008 Ferrara
D582,607 S 12/2008 Ferrara
D583,507 S 12/2008 Stingone
D587,407 S 2/2009 Nimmons
D587,852 S 3/2009 Nimmons
D587,853 S 3/2009 Nimmons
D587,854 S 3/2009 Nimmons
D587,855 S 3/2009 Nimmons
D592,809 S 5/2009 Broersma
D603,099 S 10/2009 Bologna et al.
D603,100 S 10/2009 Bologna
D625,050 S 10/2010 Chen
D628,121 S 11/2010 Reilly
D628,347 S 11/2010 Chen
D629,162 S 12/2010 Daniel
7,865,976 B2 * 1/2011 Beddoe ..... A42B 3/125 2/425
D634,896 S 3/2011 Weber
D636,536 S 4/2011 Lee
D636,941 S 4/2011 Pye
7,987,525 B2 * 8/2011 Summers ..... A42B 3/281 2/410
D645,210 S 9/2011 Chilson
8,015,624 B2 9/2011 Baldackin
D651,355 S 12/2011 Schwabe
D654,629 S 2/2012 Chou
D654,630 S 2/2012 Chou et al.
D654,632 S 2/2012 Chou
D665,132 S 8/2012 Shook
D665,154 S 8/2012 Richards
D666,775 S 9/2012 Junker
D669,225 S 10/2012 Woxing
D670,447 S 11/2012 Emrich
D671,687 S 11/2012 Winningham
D677,006 S 2/2013 Pfanner
D678,617 S 3/2013 Erb et al.
D679,867 S 4/2013 Jones
D680,275 S 4/2013 Janetos
D681,280 S 4/2013 Bologna
D681,281 S 4/2013 Bologna et al.
8,499,366 B2 8/2013 Nimmons et al.
D696,465 S 12/2013 Hwang
D697,270 S 1/2014 Simpson
D708,395 S 7/2014 LaRocque
2005/0241049 A1 * 11/2005 Ambuske ..... A42B 3/06 2/412
2006/0059606 A1 * 3/2006 Ferrara ..... A01N 25/18 2/412
2010/0200003 A1 * 8/2010 Armstrong ..... A42B 1/24 128/869

(56) References Cited

U.S. PATENT DOCUMENTS

| | | | | |
|---|---|---|---|---|
| 2012/0047636 | A1* | 3/2012 | Fehmel | A42B 3/00 2/421 |
| 2012/0297525 | A1 | 11/2012 | Bain | |
| 2012/0317704 | A1* | 12/2012 | Coyle | A42B 3/06 2/411 |
| 2013/0014313 | A1 | 1/2013 | Erb | |
| 2013/0042396 | A1 | 2/2013 | Wehtje | |
| 2014/0201889 | A1* | 7/2014 | Pietrzak | A42C 2/007 2/410 |
| 2015/0250248 | A1* | 9/2015 | Jacobsen | A42B 3/066 2/421 |
| 2015/0320134 | A1* | 11/2015 | Stolker | A42B 3/069 2/411 |

* cited by examiner

VENTED SOFT-SIDED HELMET

SUMMARY

According to one aspect of the present disclosure, a soft-sided helmet may comprise a ventilation system. The ventilation system may comprise at least two radial vents, including a first radial vent and a second radial vent; at least a first air channel connecting the first radial vent to at least one other radial vent; and at least a second air channel connecting the second radial vent to at least one other radial vent. The first radial vent may oppose the second radial vent. The ventilation system may further comprise a third radial vent, a fourth radial vent, a fifth radial vent, and a sixth radial vent. Optionally, each radial vent may be connected by: at least one air channel to at least one other radial vent; at least two air channels to at least two other radial vents; or at least four air channels to at least two other radial vents.

According to another aspect of the present disclosure, the helmet may further comprise a neck region and a forehead region separated by a circumferential length. The ventilation system may further comprise at least one central air channel extending at least substantially the entire circumferential length between the neck region and the forehead region. The helmet may further comprise a central equator extending from the neck region to the forehead region. The at least one central air channel may extend along the central equator for at least substantially the circumferential length.

According to another aspect of the present disclosure, the helmet may further comprise first and second opposing hemispheral portions. The ventilation system may further comprise at least a seventh radial vent, and an eighth radial vent. The first, third, fifth, and seventh radial vents may be disposed on the first hemispheral portion and the second, fourth, sixth, and eighth radial vents may be disposed on the second hemispheral portion. The first, third, fifth, and seventh radial vents may be disposed symmetrically with respect to the second, fourth, sixth, and eighth radial vents. The ventilation system may further comprise at least one air channel connecting at least one radial vent to a temple region of the helmet.

According to another aspect of the present disclosure, a soft-sided helmet may comprise a chin strap, a strap side, and a strap connection side. The chin strap may be attached to the helmet on the strap side. The chin strap may releasably fasten to the helmet on the strap connection side.

According to another aspect of the present disclosure, a soft-sided helmet may comprise an ear cup indentation providing space for a wearer's ear within an interior of the helmet.

According to another aspect of the present disclosure, a soft-sided helmet may comprise an at least partially spheroidal body region having a body diameter and a lower collar region having a collar diameter. The collar diameter may be configured to be narrower than the body region such that the lower collar region provides a suction effect to maintain the helmet on a wearer's head.

According to another aspect of the present disclosure, a soft-sided helmet may comprise a body thickness and a compressed rim having a compressed rim thickness. The compressed rim may be configured to allow an exterior webbing to be sewn onto the compressed rim. The compressed rim thickness may be less than the body thickness.

According to another aspect of the present disclosure, a soft-sided helmet may comprise at least one lower collar side region and at least one lower collar rear region. The at least one lower collar rear region may be raised relative to the at least one lower collar side region such that the helmet may remain in substantially the same position on a wearer's head when the wearer rotates his or her head upwards.

According to another aspect of the present disclosure, a soft-sided helmet may be manufactured by molding first and second opposing hemispheral portions, and joining the first and second opposing hemispheral portions. Each of the radial vents and air channels may be formed in the first and second opposing hemispheral portions during molding. The first and second opposing hemispheral portions may be joined along a central equator.

According to another aspect of the present disclosure, a soft-sided helmet may be manufactured by molding first and second opposing hemispheral portions; joining the first and second opposing hemispheral portions; compressing a perimeter area of the helmet to form a compressed rim; and sewing an exterior webbing onto the compressed rim.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

BRIEF DESCRIPTION OF SEVERAL VIEWS OF THE DRAWINGS

The following is a description of the examples depicted in the accompanying drawings. The figures are not necessarily to scale, and certain features and certain views of the figures may be shown exaggerated in scale or in schematic in the interest of clarity or conciseness.

Figure 1:
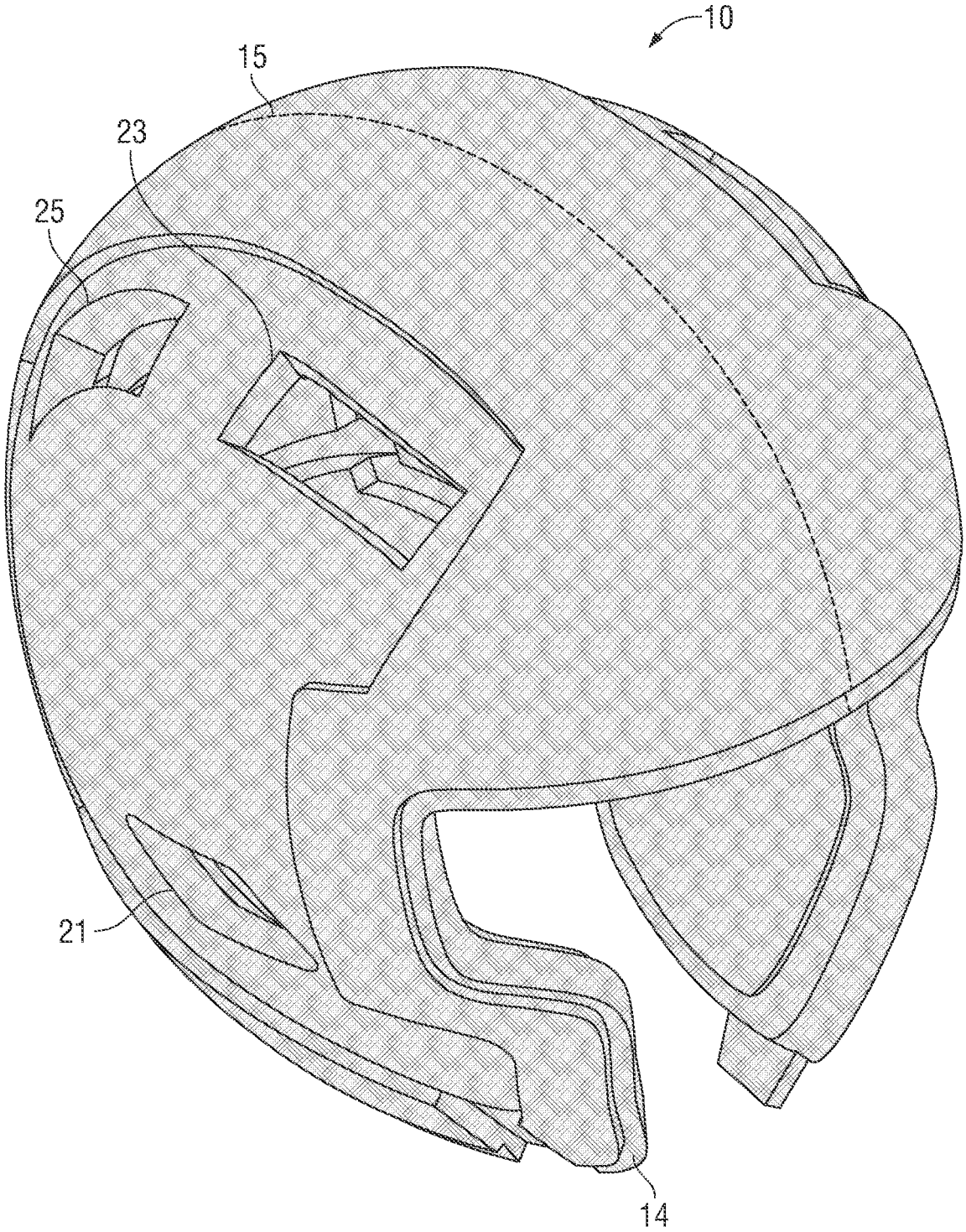
FIG. 1 is a top perspective view of a soft-sided helmet.

The following reference characters are used in this specification:

3 Cross-sectional view
4 Cross-sectional view
10 Helmet
11 Neck region
12 Forehead region
13 Temple region
14 Rim
15 Central equator
16 Hemispheral portion
17 Hemispheral portion
21 Radial vent
22 Radial vent

23 Radial vent
24 Radial vent
25 Radial vent
26 Radial vent
27 Radial vent
28 Radial vent
30 Air channel
31 Air channel
32 Air channel
33 Air channel
34 Air channel
35 Air channel
36 Air channel
40 Air channel
41 Air channel
42 Air channel
43 Air channel
44 Air channel
45 Air channel
46 Air channel
47 Air channel
48 Air channel
51 Air channel
52 Air channel
53 Air channel
54 Air channel
55 Air channel
56 Air channel
60 Air channel
61 Air channel
62 Air channel
63 Air channel
64 Air channel
65 Air channel
66 Air channel
67 Air channel
68 Air channel
70 Chin strap
72 Strap side
74 Strap connection side
75 Velcro pad
76 Velcro pad
77 Extending tab
80 Webbing
82 Webbing
90 Ear cup indentation
92 Ear cup indentation The foregoing summary, as well as the following detailed description of certain inventive techniques, will be better understood when read in conjunction with the figures. It should be understood that the claims are not limited to the arrangements and instrumentality shown in the figures. Furthermore, the appearance shown in the figures is one of many ornamental appearances that can be employed to achieve the stated functions of the apparatus.

DETAILED DESCRIPTION

In the following detailed description, specific details may be set forth in order to provide a thorough understanding of embodiments of the present invention. However, it will be clear to one skilled in the art when embodiments of the present invention may be practiced without some or all of these specific details. In other instances, well-known features or processes may not be described in detail so as not to unnecessarily obscure the invention. In addition, like or identical reference numerals may be used to identify common or similar elements.

As shown in FIG. 1, a soft-sided helmet 10 may comprise radial vents 21, 23, and 25, and a central equator 15. The soft-sided helmet 10 may be made of any suitable material, including but not limited to ethylene-vinyl acetate (EVA) foam. Radial vent 21 may be configured to provide ventilation around the ear area of a wearer and may additionally assist with maintaining the wearer's ability to hear adequately. Radial vents 23 and 25 may be configured to provide ventilation at different spots around the wearer's head. The soft-sided helmet 10 may comprise a body thickness and a compressed rim 14 having a compressed rim thickness. The compressed rim 14 may be configured to allow an exterior webbing 82 to be sewn onto the compressed rim. The compressed rim thickness may be less than the body thickness.

Figure 2:
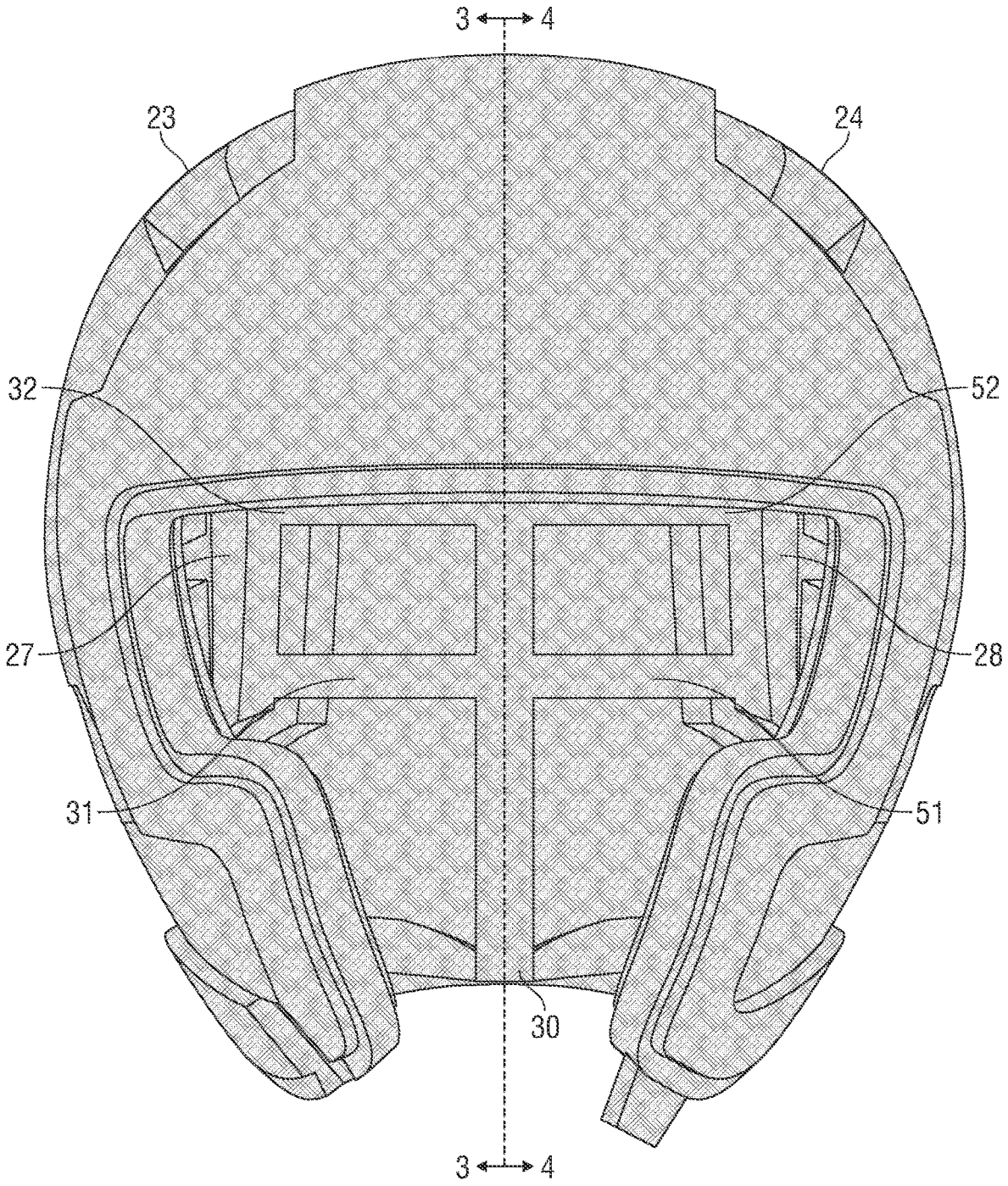
FIG. 2 is a front elevation view of a soft-sided helmet.

FIG. 2 illustrates possible configurations of air channels 30, 31, 32, 51, 52. As shown in this embodiment, the central air channel 30 may be connected to: radial vent 27 via air channels 31 and 32; and radial vent 28 via air channels 51 and 52. Air channels may be formed, for example, by using different thicknesses of the helmet material. As such, as shown in this embodiment, the central air channel 30 may be connected to at least one radial vent 27, 28 on either side of the central air channel 30 by air channels 31, 32 and 51, 52 branching out from the central sir channel 30.

Figure 3:
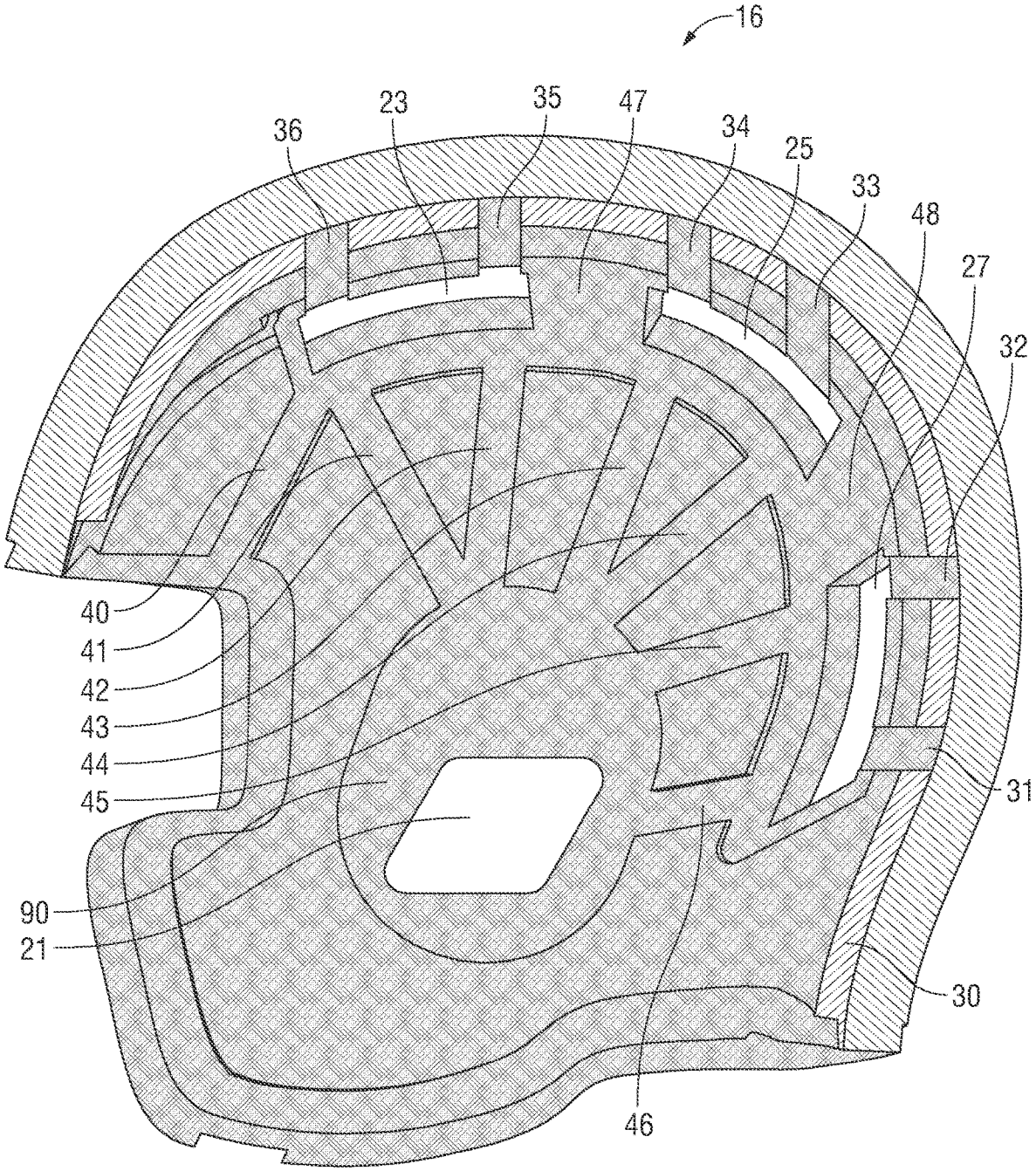
FIG. 3 is a right-side elevation cross-section view of a soft-sided helmet, taken along line 3-3 of FIG. 2.

FIG. 3 provides a cross-sectional view illustrating a possible embodiment of a ventilation system within the soft-sided helmet 10, showing a possible configuration of air channels and radial vents with a first hemispheral portion 16 of the soft-sided helmet 10. As shown in this embodiment, the central air channel 30 may be connected to: radial vent 27 via air channels 31 and 32; radial vent 25 via air channels 33 and 34; and radial vent 23 via air channels 35 and 36. Air channel 40, located in a temple region 13 of the soft-sided helmet 10, may connect the ventilation system to a front region of the soft-sided helmet 10. Air channels 41 and 42 may connect radial vent 23 to radial vent 21 via ear cup indentation 90. Air channels 43 and 44 may connect radial vent 25 to radial vent 21 via ear cup indentation 90. Air channels 45 and 46 may connect radial vent 27 to radial vent 21 via ear cup indentation 90. Air channel 47 may connect radial vents 23 and 25. Air channel 48 may connect radial vents 25 and 27. As shown in this embodiment, radial vent 21 may be configured to provide ventilation around the ear area of a wearer and may additionally assist with maintaining the wearer's ability to hear adequately; and radial vents 23, 25, and 27 may be configured to provide ventilation at different spots around the wearer's head.

Figure 4:
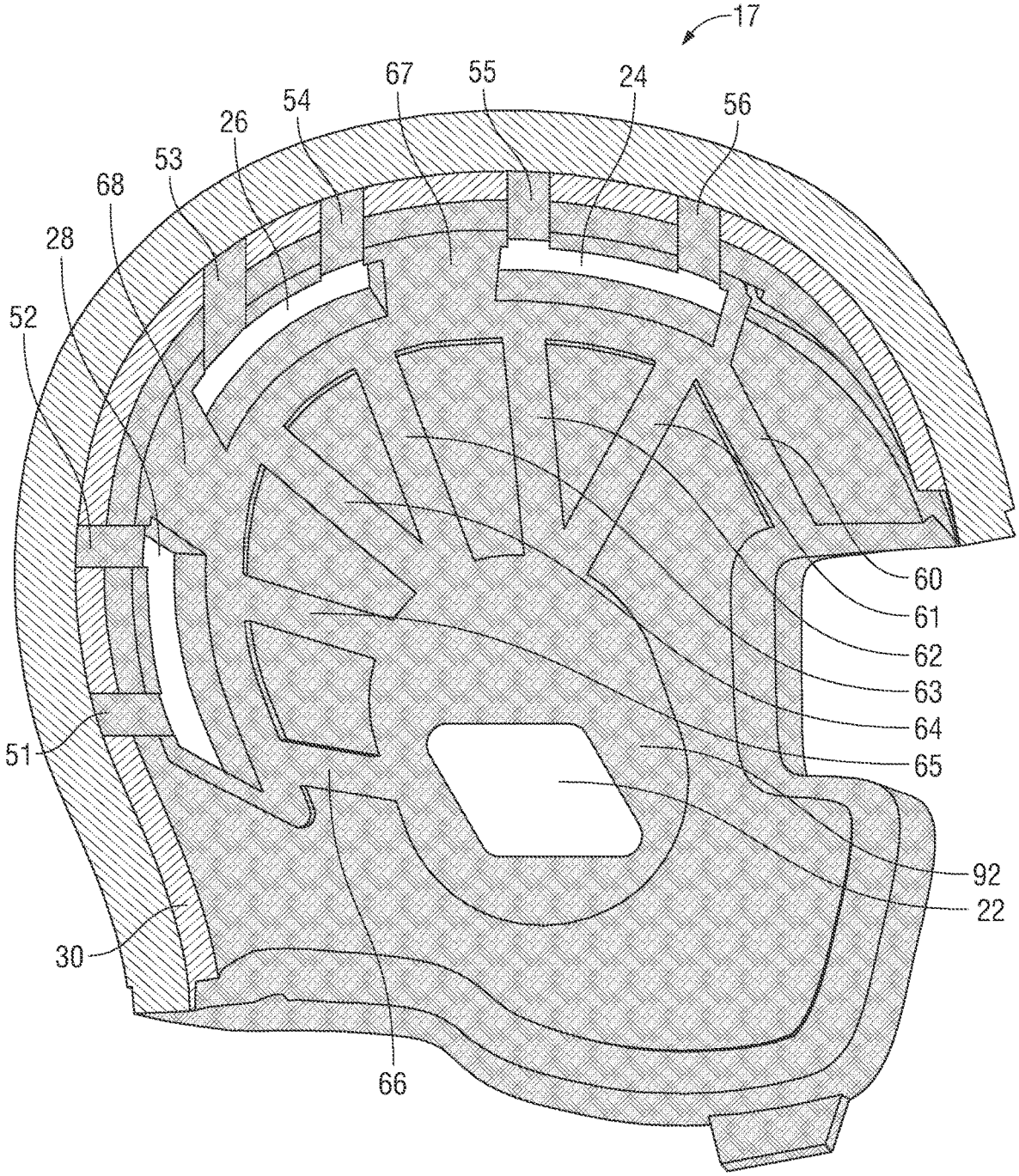
FIG. 4 is a left-side elevation cross-section view of a soft-sided helmet, taken along line 4-4 of FIG. 2.

FIG. 4 provides a cross-sectional view illustrating a possible embodiment of a ventilation system within the soft-sided helmet 10, showing a possible configuration of air channels and radial vents with a second hemispheral portion 17 of the soft-sided helmet 10. As shown in this embodiment, the central air channel 30 may be connected to: radial vent 28 via air channels 51 and 52; radial vent 26 via air channels 53 and 54; and radial vent 24 via air channels 55 and 56. Air channel 60, located in a temple region 13 of the soft-sided helmet 10, may connect the ventilation system to a front region of the soft-sided helmet 10. Air channels 61 and 62 may connect radial vent 24 to radial vent 22 via ear cup indentation 92. Air channels 63 and 64 may connect radial vent 26 to radial vent 22 via ear cup indentation 92. Air channels 65 and 66 may connect radial vent 28 to radial vent 22 via ear cup indentation 92. Air channel 67 may connect radial vents 24 and 26. Air channel 68 may connect radial vents 26 and 28. As shown in this embodiment, radial vent 22 may be configured to provide ventilation around the ear area of a wearer and may additionally assist with maintaining the wearer's ability to hear adequately; and radial vents 24, 26, and 28 may be configured to provide ventilation at different spots around the wearer's head.

Figure 5:
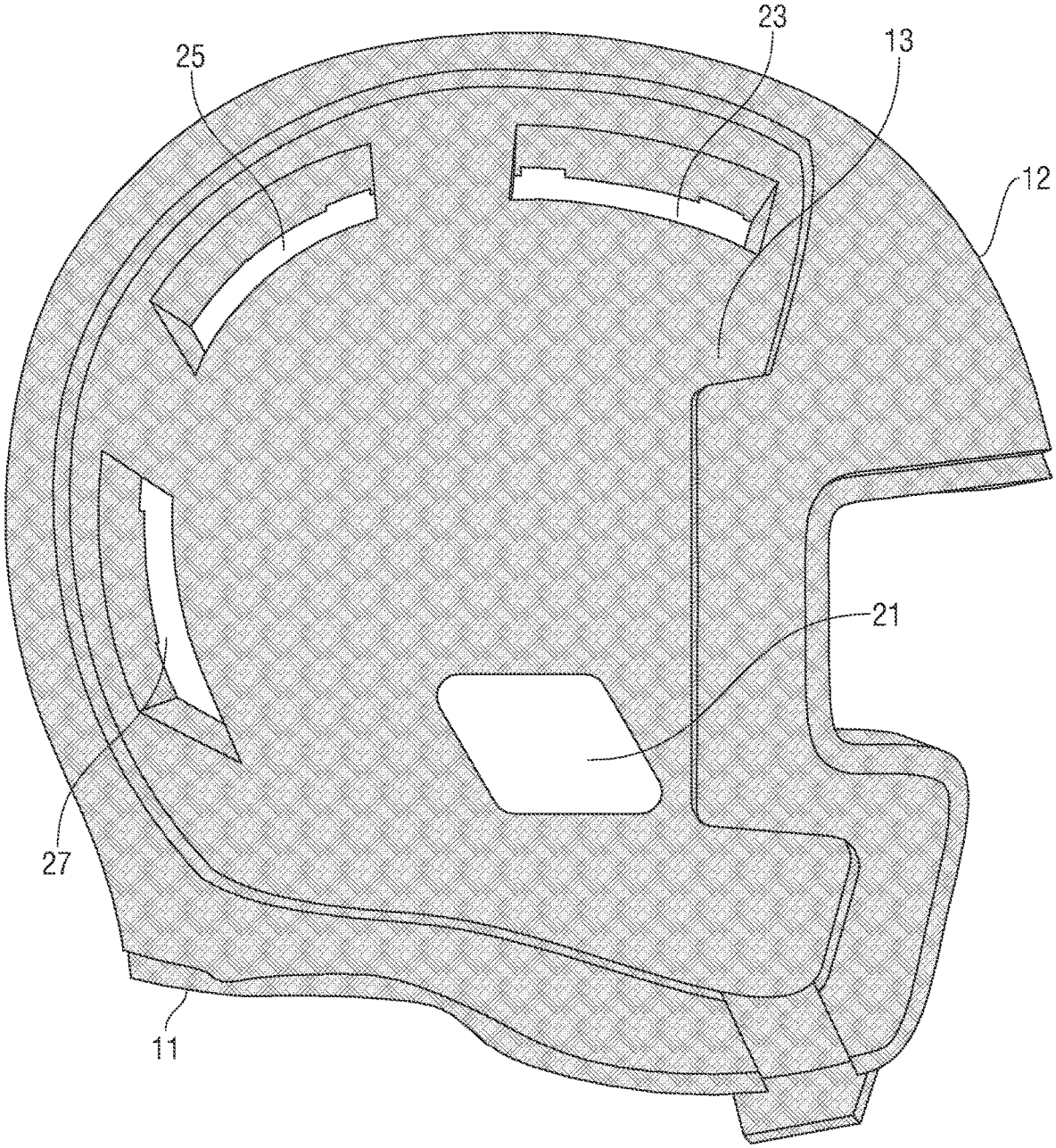
FIG. 5 is a left-side elevation view of a soft-sided helmet.

FIG. 5 shows an exterior of the soft-sided helmet 10, showing possible locations for radial vents 21, 23, 25, and 27, and neck region 11, forehead region 12, and temple region 13. The neck region 11 and the forehead region 12 may be separated by a circumferential length along the central equator 15.

Figure 6:
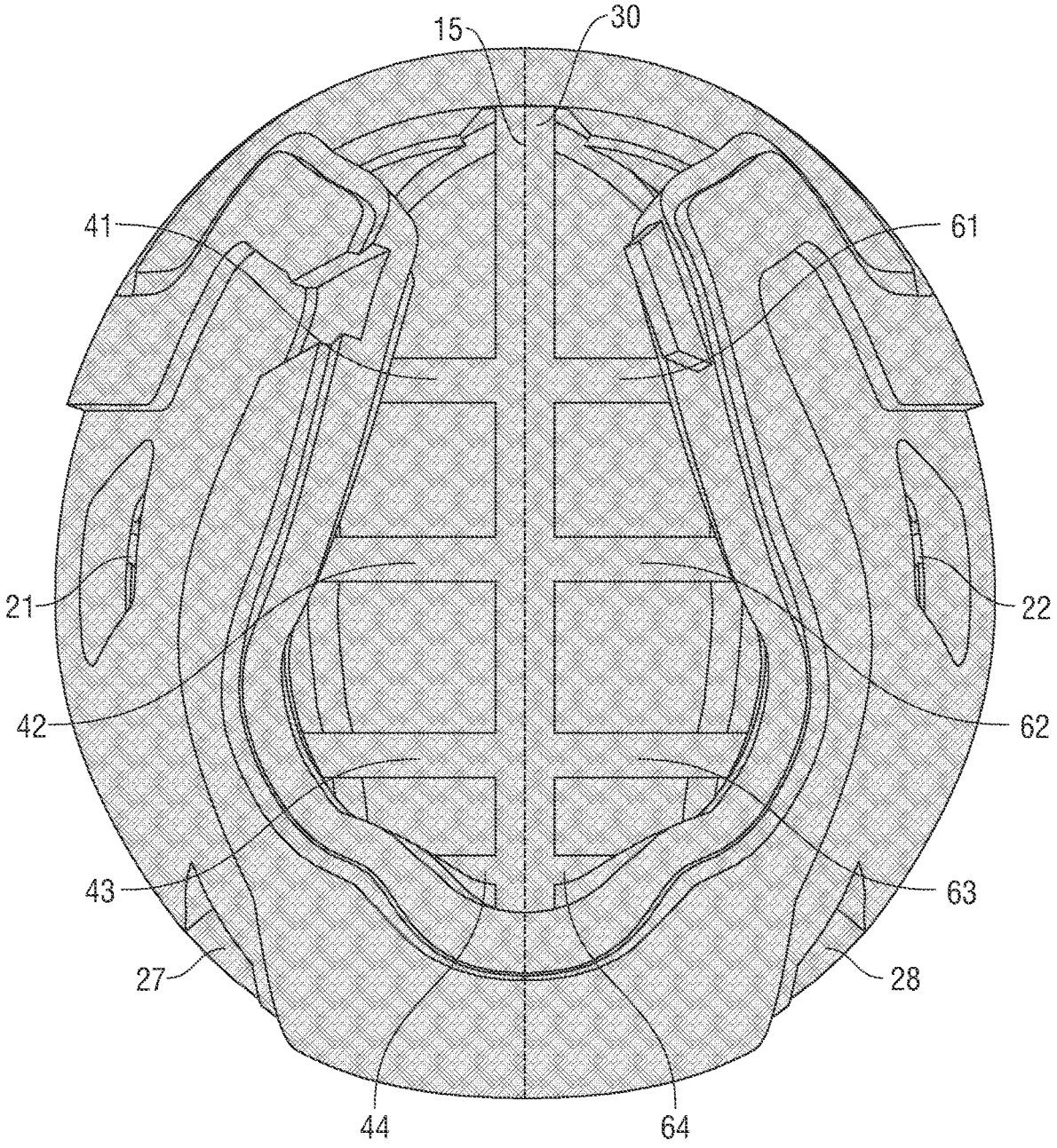
FIG. 6 is a bottom plan view of a soft-sided helmet.

FIG. 6 provides a bottom plan view of a possible embodiment of a soft-sided helmet 10, showing possible locations for radial vents 21, 22, 27, and 28, and air channels 30, 41, 42, 43, 44, 61, 62, 63, and 64. A collar diameter may be defined as a distance between the opposing sides of the soft-sided helmet 10 at the base of the soft-sided helmet 10. A body diameter may be defined as a distance between the opposing sides of the helmet 10 at a central region between the top and base of the soft-sided helmet 10. According to the present embodiment, the collar diameter may be narrower than the body diameter. The configuration of the narrower collar diameter and wider body diameter results in a suction effect that maintains the soft-sided helmet 10 on a wearer's head. According to the present embodiment, a raised portion at the rear of the collar region may ensure that the soft-sided helmet 10 remains in substantially the same position on a wearer's head when the wearer rotates his or her head upwards.

Figure 7:
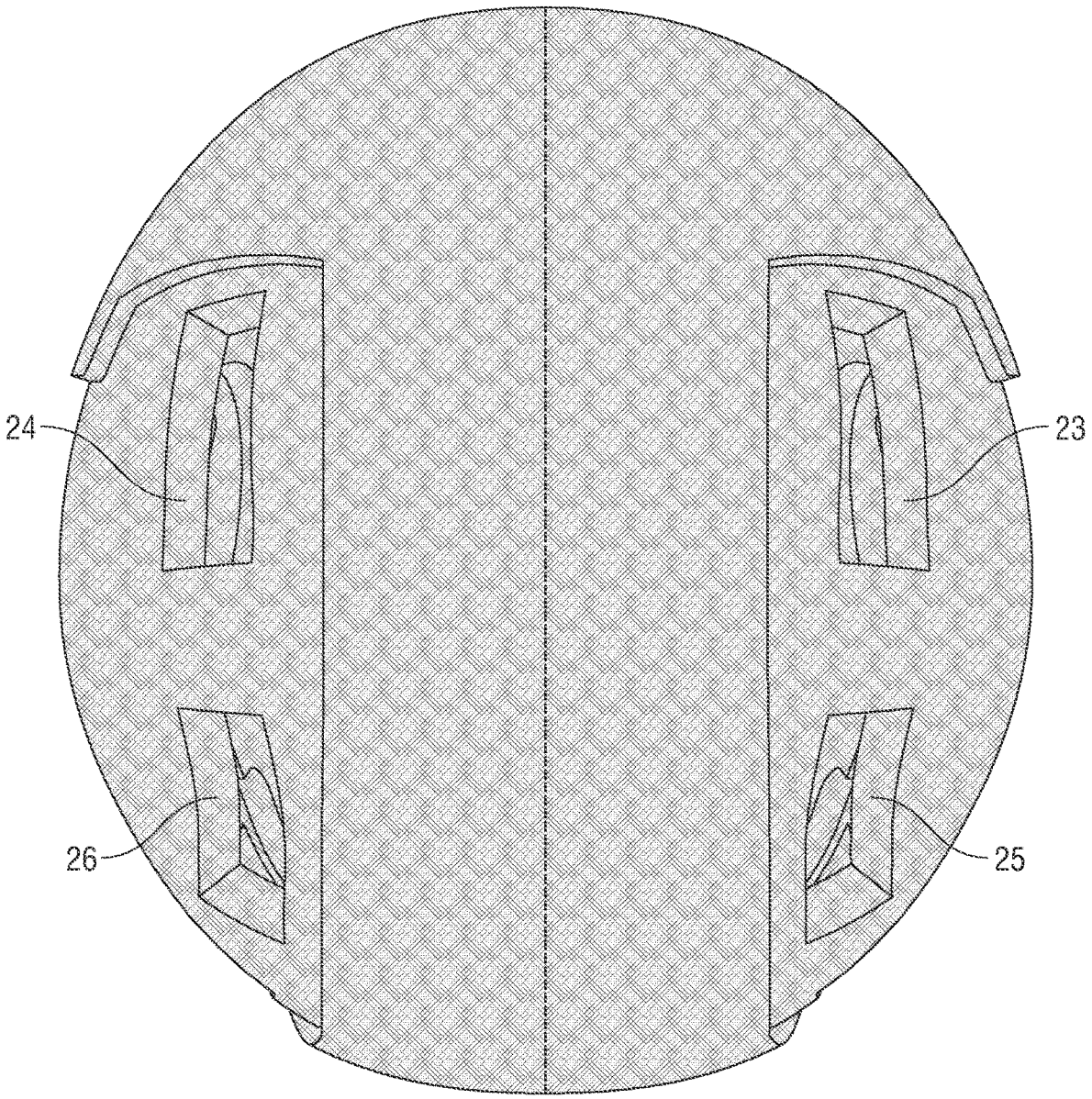
FIG. 7 is a top plan view of a soft-sided helmet.

FIG. 7 provides a top plan view of a possible embodiment of a soft-sided helmet 10, showing possible locations for radial vents 23, 24, 25, and 26.

Figure 8:
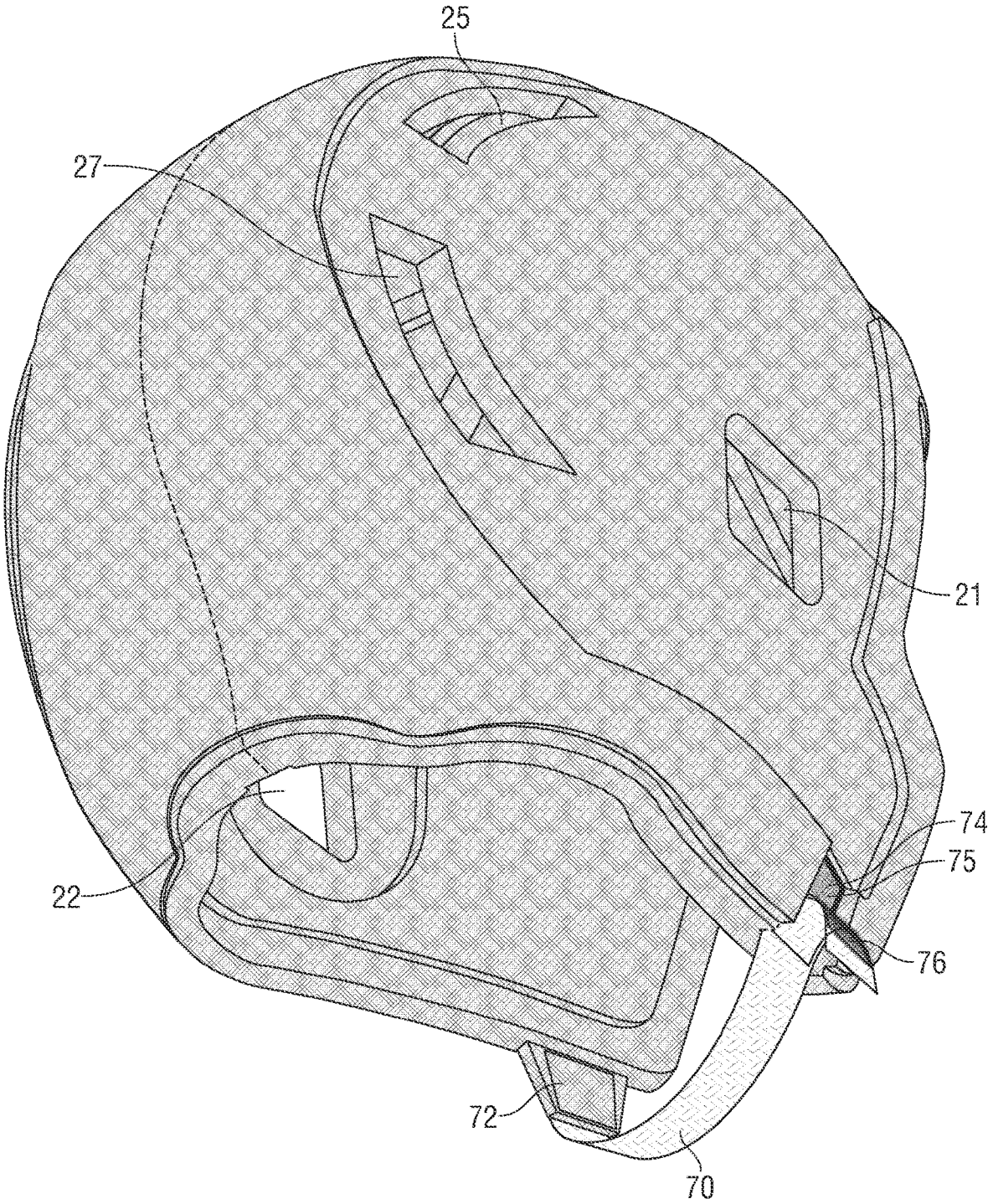
FIG. 8 is a rear perspective view of a soft-sided helmet, showing an example chin strap.

FIG. 8 shows an example chin strap 70 on an embodiment of a soft-sided helmet 10. FIG. 8 also shows possible locations for radial vents 21, 22, 27, and 28. The chin strap 70 may be attached to the strap side 72, for example by sewing or gluing a portion of the chin strap 70 to the strap side 72. The chin strap 70 may be releasably fastened to the strap connection side 74, for example by opposing Velcro pads 75, 76 or by a button arrangement.

Figure 9:
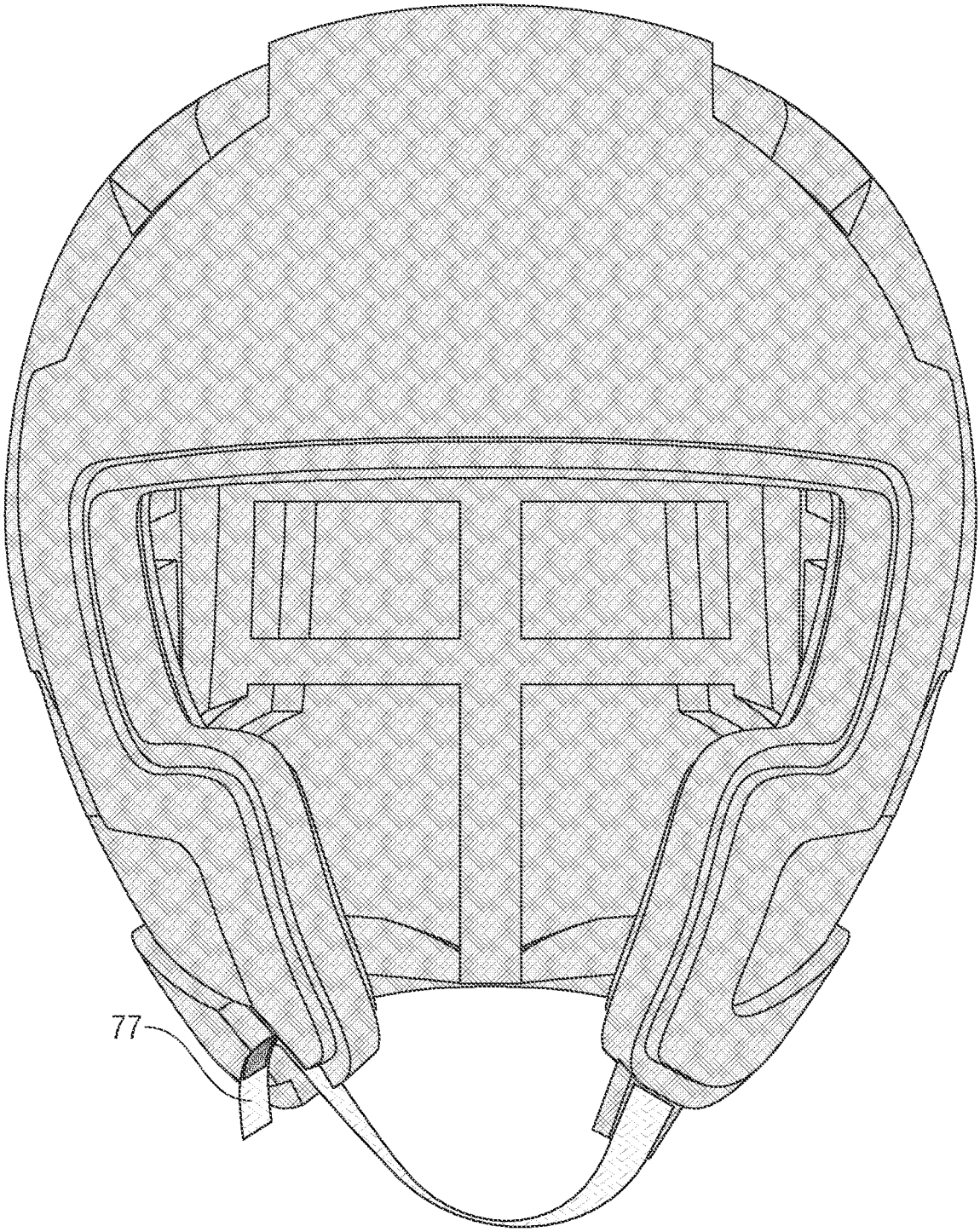
FIG. 9 is a front elevation view of a soft-sided helmet, showing an example chin strap.
Figure 10:
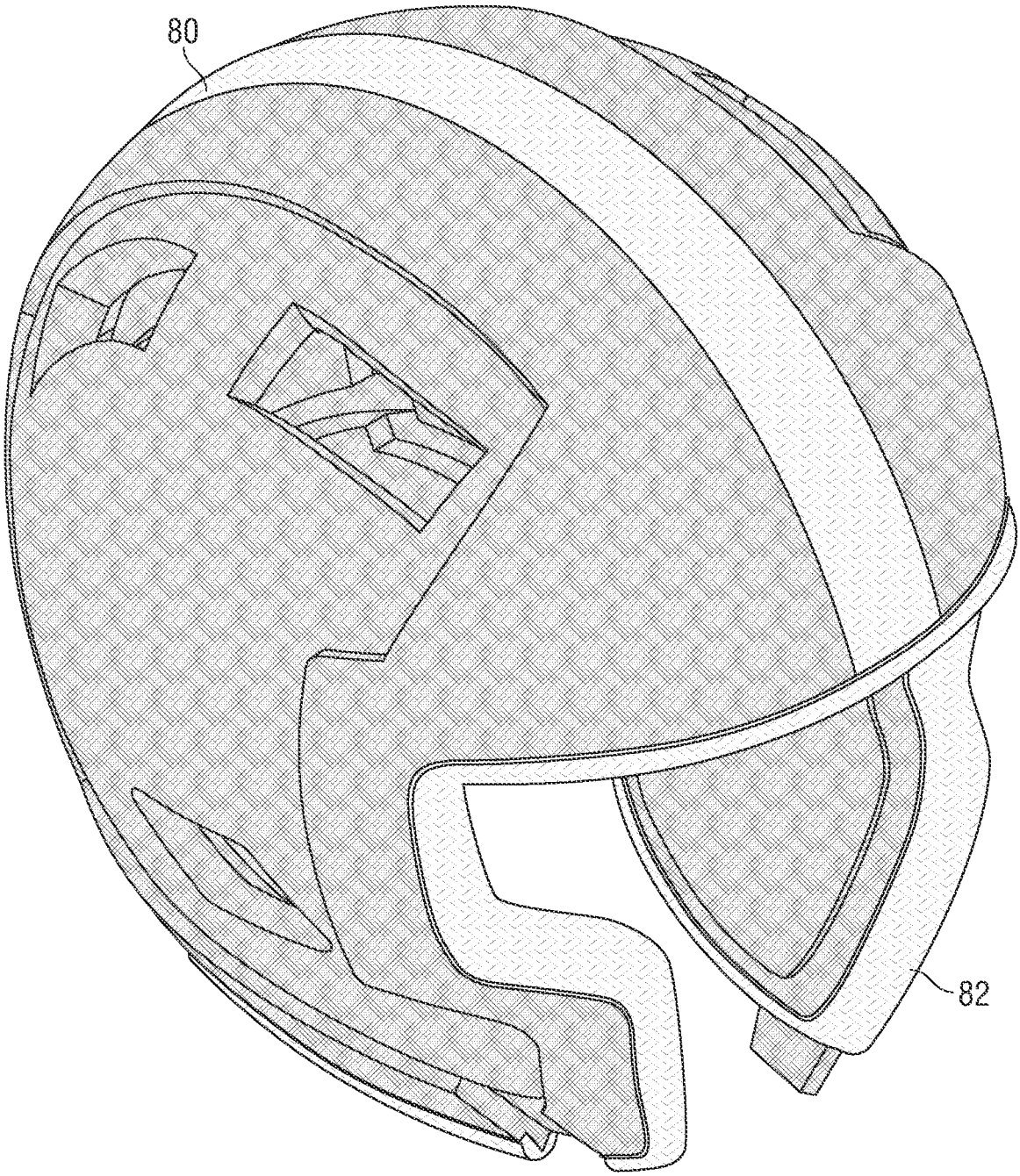
FIG. 10 is a top perspective view of a soft-sided helmet, showing an example exterior webbing and central equator webbing.

FIG. 9 shows an example chin strap 70 on an embodiment of a soft-sided helmet 10. Optionally, the chin strap 70 may include an extending tab 77, such that when the chin strap is releasably fastened to the strap connection side 74, a wearer may more readily unfasten the chin strap 70. In addition, the extending tab 77 may allow a glove-wearing wearer to unfasten the chin strap 70 without contacting opposing Velcro pads 75, 76.

FIG. 7 provides a top perspective view of a possible embodiment of a soft-sided helmet 10, showing an exterior webbing 82 attached onto the compressed rim 14, and webbing 80 attached over the central equator 15.

The soft-sided helmet 10 may be formed by a molding process. The molding process may involve injection molding, compression molding, direct injection expanded foam molding, or another suitable process. Optionally, each of the radial vents 21-28 and air channels 30-36, 40-48, 51-56, 60-68 may be formed in the soft-sided helmet 10 during the molding process. Optionally, the molding process may involve forming two opposing hemispheral portions 16, 17. The hemispheral portions 16, 17 may be joined after the molding process. For example, the hemispheral portions 16, 17 may be joined along a central equator 15. Optionally, the hemispheral portions 16, 17 may be joined using an adhesive, electrothermal melt joining, sewing, or another suitable technique. Optionally, after joining the hemispheral portions 16, 17, a perimeter area of the soft-sided helmet 10 may be compressed to form a compressed rim 14. Optionally, an exterior webbing 82 or trim may be attached (e.g., sewn or glued) onto the compressed rim 14. Optionally, after joining the hemispheral portions 16, 17, webbing 80 or trim may be attached (e.g., sewn or glued) over the central equator 15.

Some of the elements described herein are identified explicitly as being optional, while other elements are not identified in this way. Even if not identified as such, it will be noted that, in some embodiments, some of these other elements are not intended to be interpreted as being necessary, and would be understood by one skilled in the art as being optional.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A helmet consisting essentially of:

a soft interior made of a soft material and a soft exterior made of the soft material; wherein the soft exterior is the most exterior surface of the helmet;

two opposing sides; and a ventilation system, the ventilation system comprising:

at least two radial vents configured to provide ventilation through the at least two radial vents, including a first radial vent and a second radial vent, wherein the first radial vent is disposed on one opposing side opposite the second radial vent on the other opposing side of the helmet, wherein each radial vent is connected by at least one air channel to at least one other radial vent, wherein each of the air channels are formed in the soft interior of the soft helmet so that air can flow through the air channels while a wearer's head is in the helmet.

2. The helmet of claim 1, wherein the ventilation system further comprises:

a third radial vent, a fourth radial vent, a fifth radial vent, and a sixth radial vent; and wherein each radial vent is connected by at least one air channel to at least one other radial vent.

3. The helmet of claim 2, wherein the helmet further comprises:

first and second opposing hemispheral portions conjoined by a central equator; and wherein the ventilation system further comprises:

at least a seventh radial vent, and an eighth radial vent;

wherein the first, third, fifth, and seventh radial vents are disposed on the first hemispheral portion on one side of the central equator; and wherein the second, fourth, sixth, and eighth radial vents are disposed on the second hemispheral portion on the other side of the central equator.

4. The helmet of claim 3, wherein the first, third, fifth, and seventh radial vents are disposed symmetrically with respect to the second, fourth, sixth, and eighth radial vents.

5. The helmet of claim 3, wherein an exterior webbing is attached over the central equator.

6. The helmet of claim 2, wherein the ventilation system further comprises at least one air channel connecting at least one radial vent to a temple region of the helmet.

7. The helmet of claim 1, further comprising:

a neck region and a forehead region separated by a circumferential length;

a central equator extending from the neck region to the forehead region along the circumferential length;

wherein the ventilation system further comprises at least one central air channel extending at least partially along the central equator, and;

wherein the central air channel is connected to at least one radial vent on either side of the central air channel by air channels branching out from the central air channel.

8. The helmet of claim 7, wherein the at least one central air channel extends along the central equator for the circumferential length.

9. The helmet of claim 1, further comprising: a chin strap; a strap side; and a strap connection side; wherein the chin strap is attached to the helmet on the strap side and wherein the chin strap releasably fastens to the helmet on the strap connection side.

10. The helmet of claim 1, further comprising:

an ear cup indentation in each opposing side of the helmet providing space for a wearer's ear within an interior of the helmet, wherein each ear cup indentation further comprises an ear vent.

11. The helmet of claim 1, further comprising:

an at least partially spheroidal body region having a body diameter; and a lower collar region having a collar diameter; and wherein the collar diameter is configured to be narrower than the body region such that the lower collar region provides a suction effect to maintain the helmet on a wearer's head.

12. The helmet of claim 1, wherein the soft material is ethylene-vinyl acetate (EVA) foam.

13. A helmet consisting essentially of:

a soft interior made of a soft material and a soft exterior made of the same soft material; wherein the soft exterior is the most exterior surface of the helmet;

a ventilation system, the ventilation system comprising at least four radial vents and two ear vents configured to provide ventilation through the ear vents, with each vent connected by air channels to at least two other vents;

an ear cup indentation in each opposing side of the helmet providing space for a wearer's ear within an interior of the helmet, wherein each of the ear cup indentations comprise one of the ear vents;

a body thickness;

a compressed rim having a compressed rim thickness, the compressed rim configured to allow an exterior webbing to be attached onto the compressed rim, and wherein the compressed rim thickness is less than the body thickness.

14. The helmet of claim 13, wherein the soft material is ethylene-vinyl acetate (EVA) foam.

15. The helmet of claim 13, wherein an exterior webbing is attached onto the compressed rim.

16. A helmet consisting essentially of:

a soft interior made of a soft material and a soft exterior made of the soft material; wherein the soft exterior is the most exterior surface of the helmet;

a ventilation system, the ventilation system comprising at least four radial vents and two ear vents configured to provide ventilation through the ear vents, with each vent connected by air channels to at least two other vents;

an ear cup indentation in each opposing side of the helmet providing space for a wearer's ear within an interior of the helmet, wherein each of the ear cup indentations comprise one of the ear vents;

at least one lower collar side region; and at least one lower collar rear region;

wherein the at least one lower collar rear region is raised relative to the at least one lower collar side region such that the helmet remains in substantially the same position on the wearer's head when the wearer rotates his or her head upwards.

17. The helmet of claim 16, wherein the soft material is ethylene-vinyl acetate (EVA) foam.

* * * * *